US005460483A

United States Patent [19]

Dorsch

[11] Patent Number: 5,460,483

[45] Date of Patent: Oct. 24, 1995

[54] MULTISTAGE CENTRIFUGAL CHOPPER PUMP

[75] Inventor: Glenn R. Dorsch, Aberdeen, Wash.

[73] Assignee: Vaughan Co., Inc., Montesano, Wash.

[21] Appl. No.: 385,281

[22] Filed: Feb. 8, 1995

Related U.S. Application Data

[60] Division of Ser. No. 132,117, Oct. 5, 1993, which is a continuation-in-part of Ser. No. 889,519, May 26, 1992, Pat. No. 5,256,032.

[51] Int. Cl.[6] ..... F01D 5/04

[52] U.S. Cl. ..... 415/121.1

[58] Field of Search ..... 415/121.01, 206

[56] References Cited

U.S. PATENT DOCUMENTS

| | | | |
|---|---|---|---|
| 2,265,758 | 12/1941 | Klosson | 103/111 |
| 2,714,354 | 8/1955 | Farrand | 103/111 |
| 2,934,023 | 4/1960 | Lamkin et al. | 103/103 |
| 3,155,046 | 11/1964 | Vaughan | 103/103 |
| 3,325,107 | 6/1967 | Peterson | 241/101 |
| 3,340,812 | 9/1967 | Schlesiger | 103/103 |
| 3,444,818 | 5/1969 | Sutton | 103/111 |
| 3,447,475 | 6/1969 | Blum | 103/111 |
| 3,915,394 | 10/1975 | Ferguson, Jr. | 241/185 |
| 3,973,866 | 8/1976 | Vaughan | 415/121 |
| 4,378,093 | 3/1983 | Keener | 241/46 |
| 4,430,214 | 2/1984 | Baker | 210/169 |
| 4,527,947 | 7/1985 | Elliott | 415/121 |
| 4,575,308 | 3/1986 | Corkill | 415/213 |
| 4,842,479 | 6/1989 | Dorsch | 415/121.1 |
| 5,256,032 | 10/1993 | Dorsch | 415/121.1 |

FOREIGN PATENT DOCUMENTS

| | | | |
|---|---|---|---|
| 729917 | 3/1966 | Canada . | |
| 759186 | 1/1934 | France | 415/121.1 |
| 1323707 | 6/1963 | France . | |
| 2515411 | 10/1975 | Germany . | |
| 55-117094 | 9/1980 | Japan | 415/121.1 |
| 90951 | 11/1937 | Sweden | 415/121.1 |
| 1332-077 | 8/1987 | U.S.S.R. | 415/121.1 |
| 1551918 | 9/1979 | United Kingdom . | |

OTHER PUBLICATIONS

Vaughan Company, Inc., *General Notes on Adding an Integral Cutter to a Vaughan Cutter Bar in The Field,* (1987).

*Primary Examiner*—John T. Kwon

*Attorney, Agent, or Firm*—Christensen, O'Connor, Johnson & Kindness

[57] ABSTRACT

A centrifugal pump has a bladed impeller rotating in the bowl of the pump casing. The inlet side of the pump bowl is closed by an intake plate. A hub rotated with the impeller extends through the intake plate, generally axially outward from the impeller blades. The hub has an abrupt projection in close cutting relationship with at least a portion of the intake plate as the impeller is rotated.

3 Claims, 12 Drawing Sheets

Fig. 5.
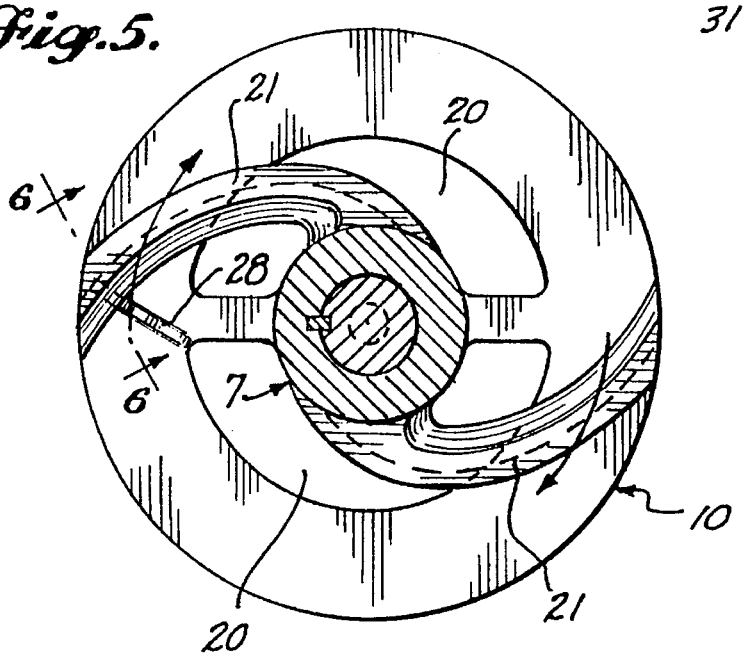
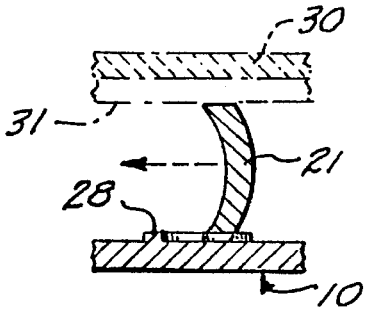
Fig. 6.
Fig. 7.
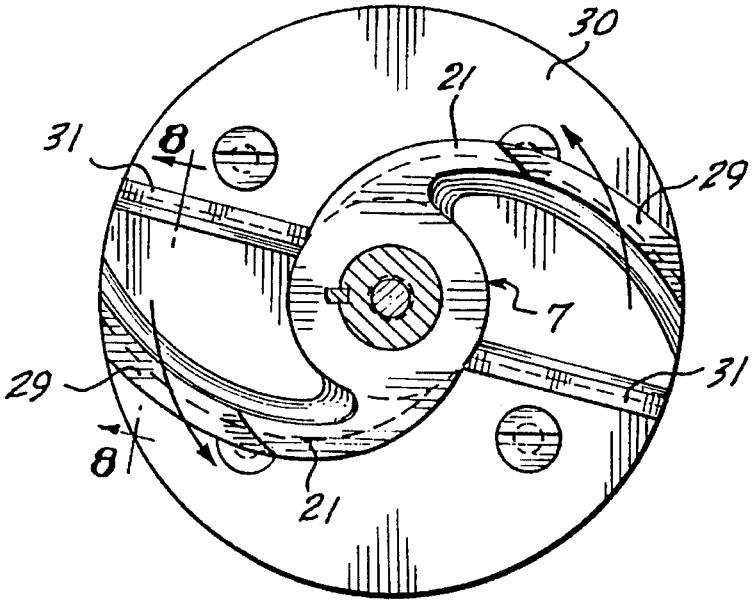
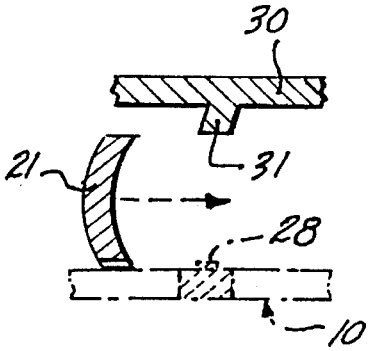
Fig. 8.

Fig. 10.
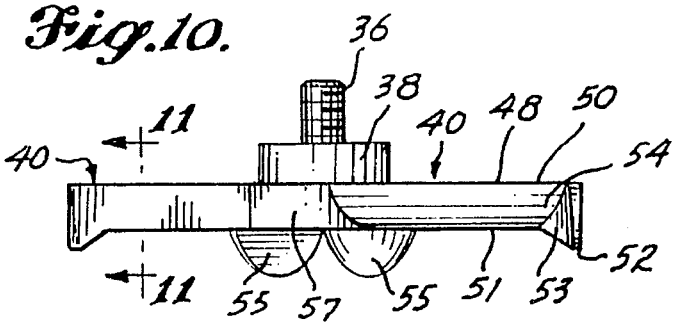
Fig. 11.
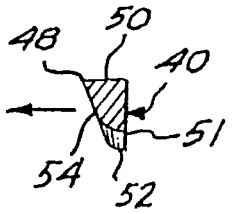
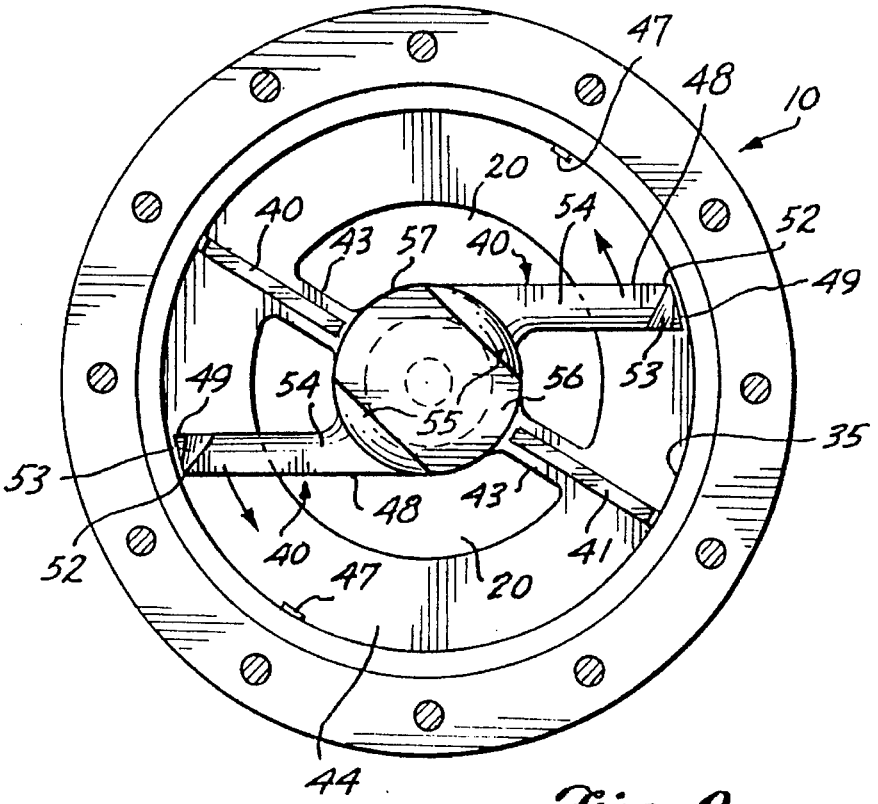
Fig. 9.

MULTISTAGE CENTRIFUGAL CHOPPER PUMP

CROSS REFERENCE

This is a divisional of the prior application Ser. No. 08/132,117, filed on Oct. 5, 1993, which in turn is a continuation-in-part of application Ser. No. 07/889,519, filed on May 26, 1992, now U.S. Pat. No. 5,256,032, the benefit of the filing dates of which are hereby claimed under 35 U.S.C. § 120.

FIELD OF THE INVENTION

The present invention relates to the general field of centrifugal pumps. More specifically, the present invention relates to a centrifugal pump effective for pumping liquids and slurries containing solid matter, including various types of refuse, and for chopping the solid matter which may thereafter be processed for disposal.

BACKGROUND OF THE INVENTION

Vaughan U.S. Pat. No. 3,155,046, issued Nov. 3, 1964, discloses a centrifugal pump having an open impeller with radial vanes. The vane edges adjacent to the pump inlet cooperate with sharpened edges of inlet apertures to cut stringy material or chunks entering the pump. Similarly, Vaughan U.S. Pat. No. 3,973,866, issued Aug. 10, 1976, and Dorsch U.S. Pat. No. 4,842,479, issued Jun. 27, 1989, disclose centrifugal pumps having impellers with vanes cooperating with inlet apertures to achieve a chopping or slicing action of solid material in a liquid or slurry being pumped. In the case of the pumps of Vaughan U.S. Pat. No. 3,973,866 and Dorsch U.S. Pat. No. 4,842,479, however, semi-open impellers having radial shroud plates are used; and external booster propellers are provided to accelerate flow into the pump, to displace chunks of solid matter which become lodged in the inlet apertures and, at least in some instances, to cut solid matter prior to entry into the pump.

Other types of pumps having external cutters rotated with an impeller or propeller are shown in Farrand U.S. Pat. No. 2,714,354, issued Aug. 2, 1955; Peterson U.S. Pat. No. 3,325,107, issued Jun. 13, 1967; and French Patent No. 1.323.707, issued Mar. 1, 1962.

Sutton U.S. Pat. No. 3,444,818, issued May 20, 1969, discloses another type of centrifugal pump having an internal impeller with vanes cooperating with the periphery of an inlet aperture to achieve a slicing action. In the Sutton construction, an outer "chopper member" has blades that wipe across the outer surface of the apertured intake plate to assist in chopping solid material to a size small enough to enter the intake aperture. Similarly, in the construction shown in British Patent No. 1,551,918, published Sep. 5, 1979, external blades sweep across small intake apertures to dislodge or gradually cut solid material clogging an intake aperture. In both the construction shown in the Sutton patent and the construction shown in the British patent, the external member is mounted so as to be moveable axially away from the intake plate if a hard obstruction is encountered.

Other types of pumps designed for pumping liquids or slurries containing solid materials are disclosed in Canadian Patent No. 729,917, issued Mar. 15, 1966; Schlesiger U.S. Pat. No. 3,340,812, issued Sep. 12, 1967; Elliott U.S. Pat. No. 4,527,947, issued Jul. 9, 1985; and Corkill U.S. Pat. No. 4,575,308, issued Mar. 11, 1986.

SUMMARY OF THE INVENTION

The principal object of the present invention is to provide a durable centrifugal pump effective for pumping liquids and slurries containing a large variety of solid refuse, including tough, resilient materials resistive to being cut, and strong, stringy, fibrous or sinewy materials which may have a tendency to wind around and clog or impede rotating components in addition to being resistive to being cut.

In the preferred embodiment of the present invention, the foregoing object is accomplished by providing a centrifugal pump having several cutting, slicing and/or chopping stages, preferably both inside and outside the bowl in which the impeller rotates. In one embodiment, the pump has an open impeller with vanes having cutting edges at both the intake side of the pump bowl and along the closed side of the bowl. At the intake side, the adjacent vane edges cooperate with intake apertures for a slicing or chopping action similar to some of the devices described above. However, the chopping effectiveness at the intake side is increased by providing at least one narrow internal anvil rib extending generally radially outward from the intake apertures to the circle defined by the free ends of the rotating impeller vanes. The radially outer portions of the impeller vanes are notched so as to pass closely over the anvil rib to achieve an internal cutting action at the intake side of the pump.

In addition, narrow anvil ribs are provided at the closed side of the pump bowl, opposite the intake side, for close cutting cooperation with the edges of the impeller vanes remote from the intake apertures. Therefore, solid matter is sliced and chopped as it enters the intake apertures, and also is sliced and chopped inside the bowl at both the intake side and the closed side during rotation of the internal impeller.

Further, the intake end plate of the pump has an outer depression or recess with the intake apertures being formed in the base of the recess. Raised anvil ribs extend across the base of the recess and in an axial direction along the peripheral portion of the recess. An external cutter rotated with the internal impeller has chopper blades which cooperate with such external anvil ribs for an exterior chopping action of matter which otherwise might become lodged in or adjacent to the intake apertures. The hub of the cutter can have sharp teeth effective to chew through tough, resilient or sinewy material and prevent such material from winding around the cutter. An intake manifold adjacent to the pump inlet can have restrictor bars extending radially inward over the axially extending peripheral anvil ribs to trap solid material and prevent it from escaping outward without being cut or chopped into smaller pieces.

In another embodiment, two or more external cutters are provided, separated by an anvil plate which can have holes limiting the maximum diameter of solid material entering the pump bowl. The innermost cutter has radial blades with one sharpened cutting edge adjacent to the intake plate leading into the pump bowl and another sharpened cutting edge adjacent to the anvil plate which is spaced outward from the pump intake. Such innermost cutter also can have sharpened ends cooperating with anvil ribs located along the peripheral portion of the recess between the pump intake and the anvil plate. An additional external cutter with sharpened edges rotates in a recess located outward of the apertured anvil plate, and still another external chopper member is spaced outward from the second cutter. Thus, material passing into the pump must flow through a plurality of cutting, slicing and/or chopping stages before reaching the impeller.

BRIEF DESCRIPTION OF THE DRAWINGS

FIG. 5 is a section taken along line 5—5 of FIG. 2 (looking toward the pump intake) with parts deleted; and FIG. 6 is a section taken along line 6—6 of FIG. 5 with parts deleted.

FIG. 7 is a section taken along line 7—7 of FIG. 2 (looking away from the pump intake) with parts deleted and parts broken away; and FIG. 8 is a section taken along line 8—8 of FIG. 7.

FIG. 9 is an intake end elevation of the pump of FIG. 2, viewed from line 9—9 of FIG. 2, illustrating the external cutter of such pump;

FIG. 10 is a side elevation of such cutter removed from the pump; and

FIG. 11 is a section of such cutter taken along line 11—11 of FIG. 10.

DETAILED DESCRIPTION OF THE PREFERRED EMBODIMENT

Figure 1:
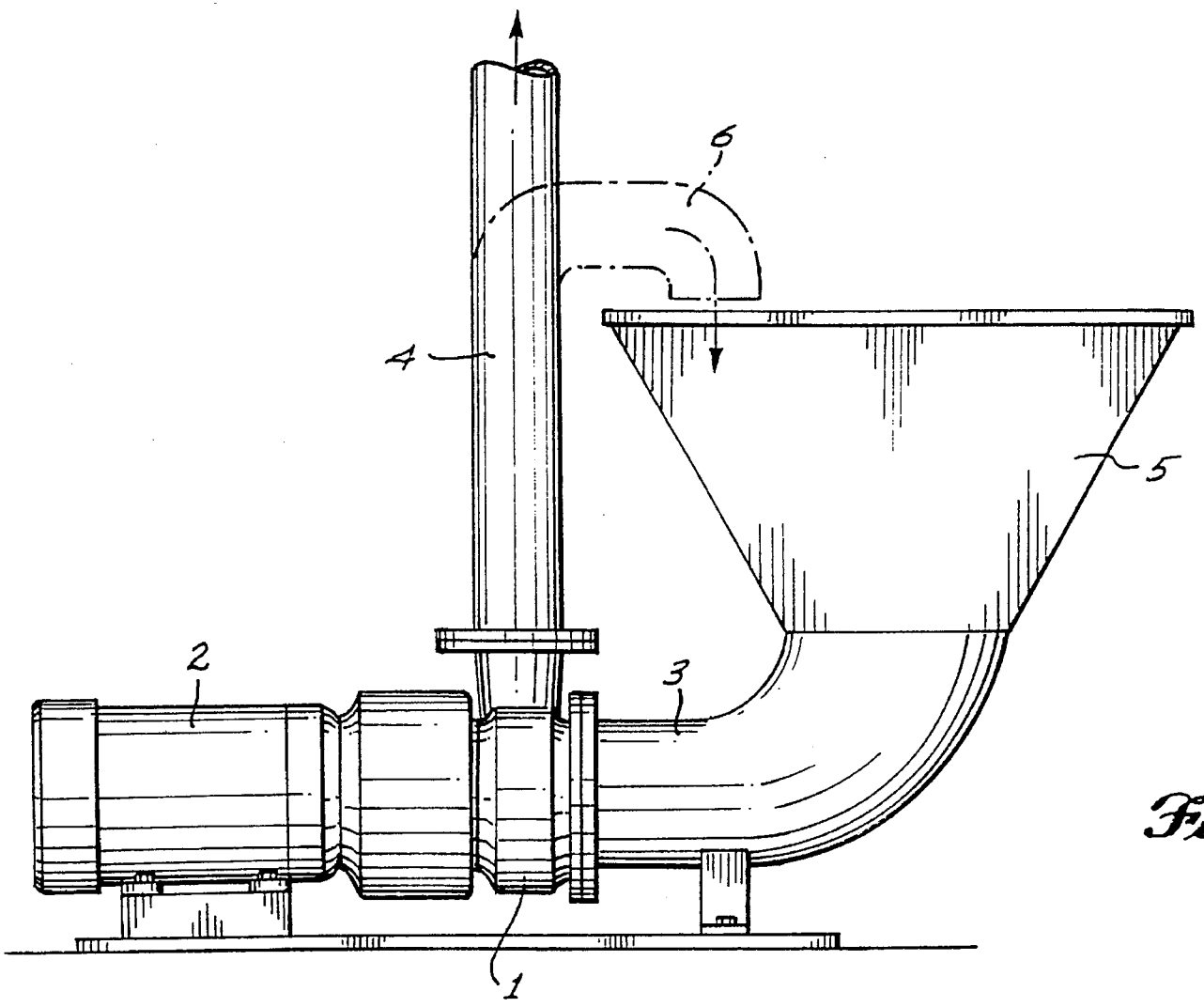
FIG. 1 is a side elevation of an installation of a multistage centrifugal chopper pump in accordance with the present invention.

FIG. 1 illustrates a representative installation of a centrifugal chopper pump 1 in accordance with the present invention. Pump 1 has an internal impeller rotated about a horizontal axis by an appropriate motor 2 so as to draw matter axially into the pump through an intake pipe or manifold 3. Such matter is discharged generally tangentially of the impeller through an outlet pipe 4. Intake pipe 3 extends to a hopper 5 for receiving refuse to be chopped and pumped. The hopper is kept filled or partially filled with water to assist in the pumping action. The mixture of water and chopped refuse can be recirculated back through the pump by way of a return pipe 6 illustrated in broken lines in FIG. 1 until such time as the refuse has been chopped sufficiently for further processing or disposal.

It is important that the pump in accordance with the present invention be capable of pumping and chopping a wide variety of materials. For example, there has been concern over processing and disposal of medical waste which often is not sorted but which is simply collected in plastic garbage bags. Processing of the medical waste may be easier if the diverse materials could be pumped to a processing location or processing equipment, particularly if the materials were chopped efficiently. Representative of such materials are: bandages and dressings which may contain adhesives so as to stick and collect on surfaces with which they come in contact; synthetic rubber gloves or other items of resilient but tough materials resistant to puncturing and cutting; various types of sinewy nettings and gauzes, including stretch hosiery and fabrics which, if not cut or chewed effectively, tend to wind around and bind or impede rotating components; and various throwaway plastic items, including the sheet plastic garbage bags themselves. Bags of such materials can be loaded into the hopper 5 and the pump 1 in accordance with the present invention is effective to chop the solid matter into small pieces and discharge the mixture of solid matter and water through the outlet pipe 4.

Figure 2:
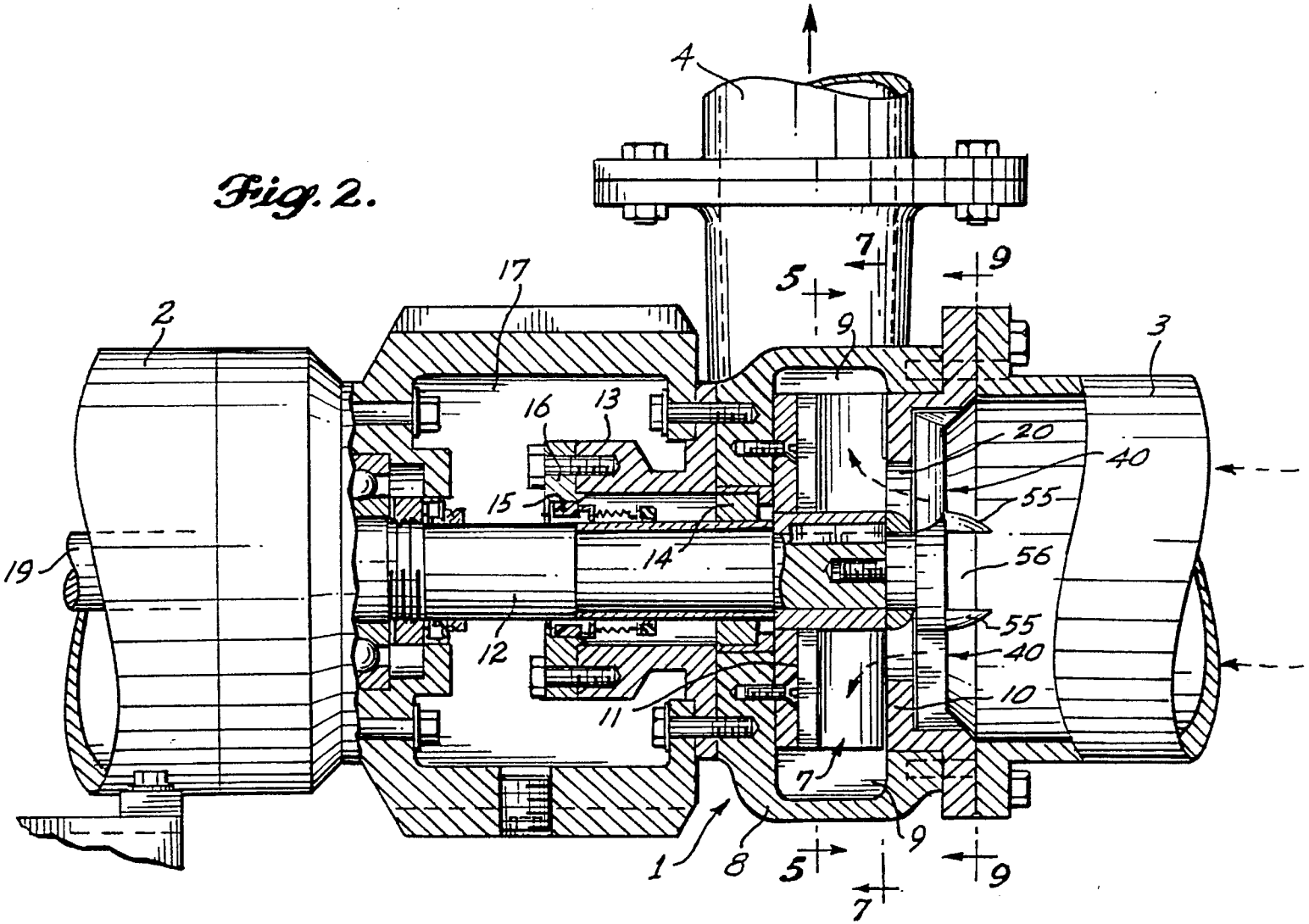
FIG. 2 is an enlarged side elevation of a multistage centrifugal chopper pump in accordance with the present invention with parts broken away to reveal the interior of the pump bowl and adjacent structure.

The internal construction of a first embodiment of pump 1 in accordance with the present invention is shown in FIG. 2 along with adjacent components of the representative installation. The internal pump impeller 7 rotates in a generally cylindrical casing 8 defining a volute bowl 9 having an open side partially closed by an intake plate 10. Bowl 9 has a closed side 11 through which the impeller drive shaft 12 extends. Shaft 12 extends from the impeller through a stuffing box 13 of conventional design including a bushing 14 at one end, in which the drive shaft is journaled adjacent to the closed side of the pump bowl, and a mechanical seal 15 and gland ring 16 at the other end of the stuffing box. The stuffing box is enclosed in a packing housing 17. Outside the stuffing box, the impeller shaft 12 extends through conventional bearings 18 and is coupled to or integral with the motor output shaft 19. Rotation of the impeller 7 by its drive shaft 12 induces material to be sucked axially inward through intake apertures 20 of end plate 10. Such material is slung outward to the periphery of and circumferentially of the bowl 9 until it is discharged through the outlet pipe 4.

Figure 3:
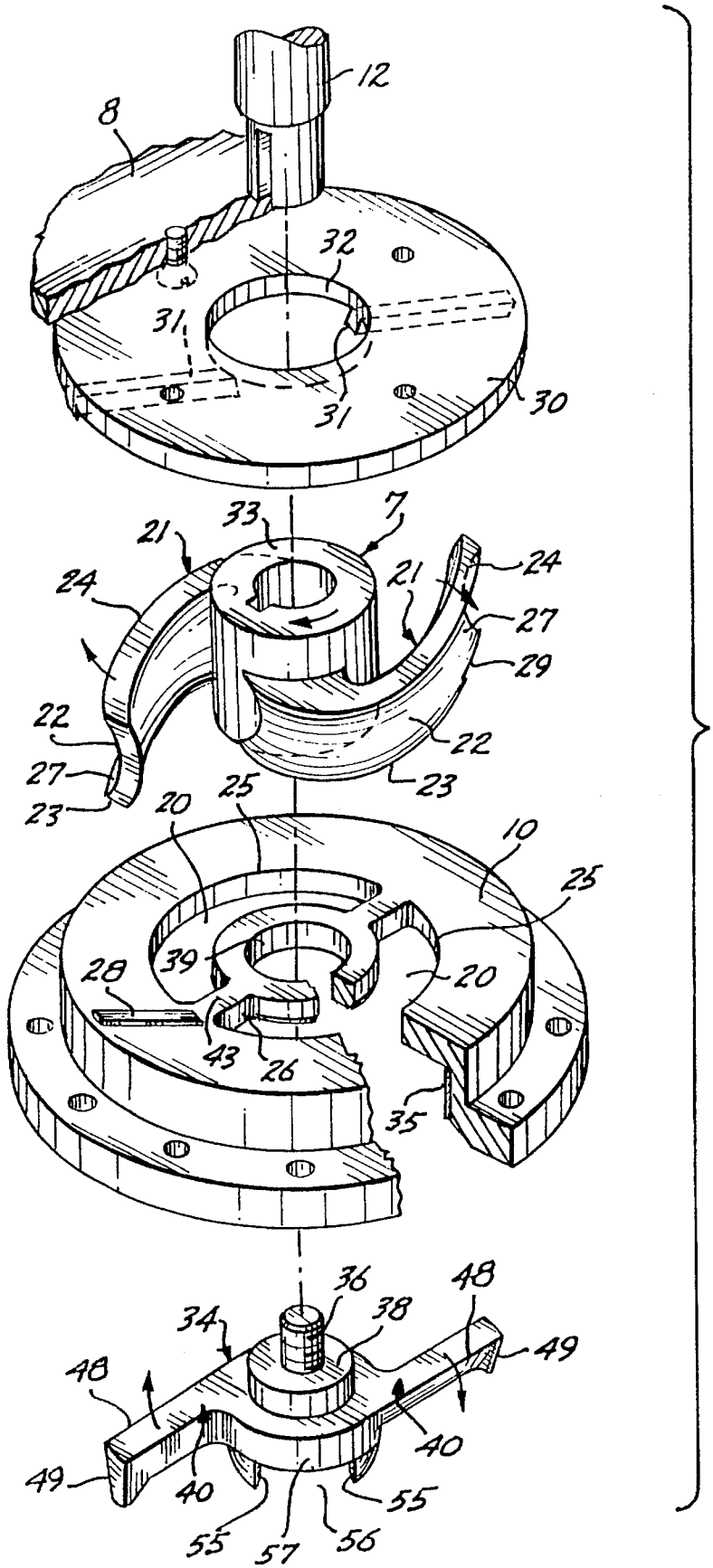
FIG. 3 is a fragmentary perspective of components of the pump of FIG. 2 taken from the closed side of the pump bowl, with parts shown in exploded relationship.
Figure 4:
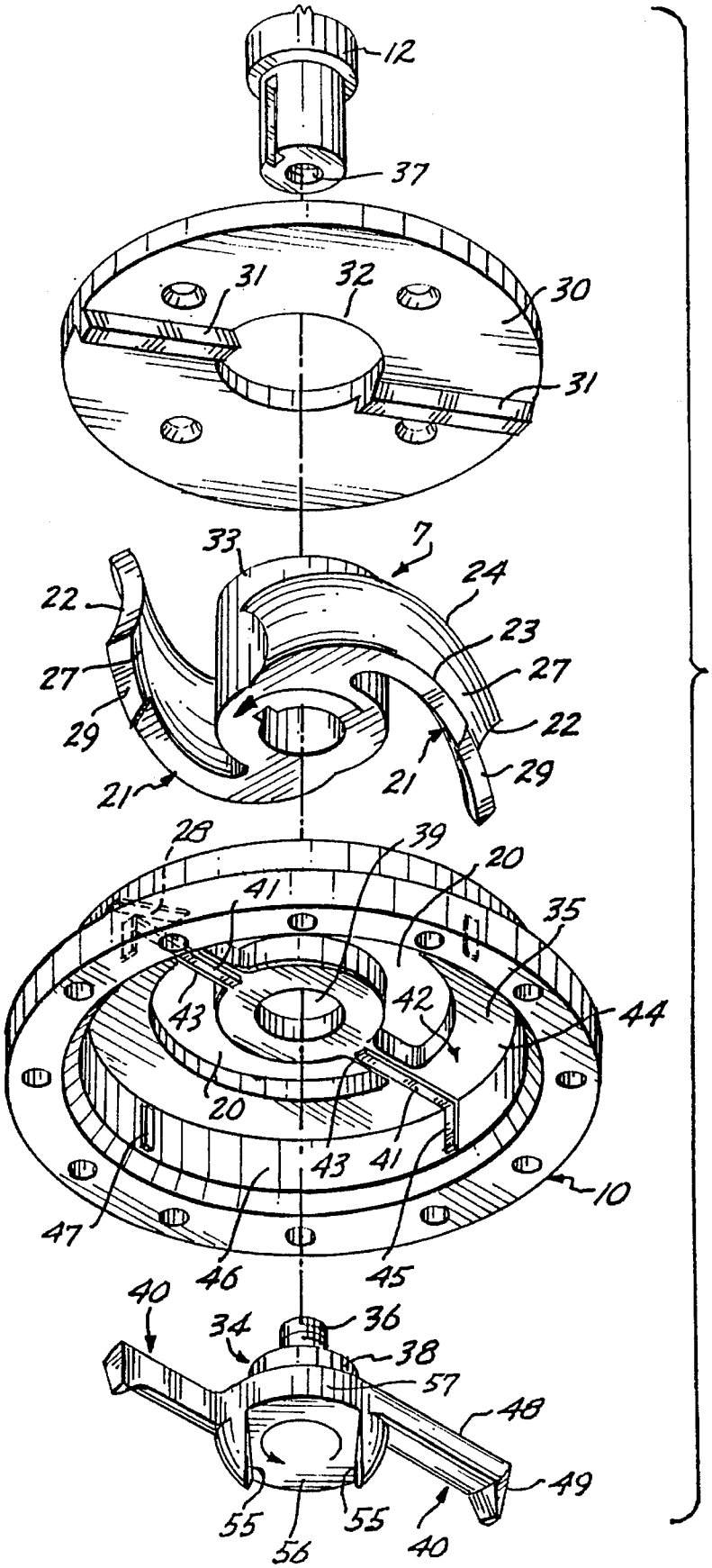
FIG. 4 is a corresponding perspective of such components but taken from the intake side of the pump.

The cooperating chopping components of the pump in accordance with the present invention are best seen in FIGS. 3 and 4. For internal chopping of solid matter in the liquid being pumped, the impeller 7 is of open design having two or more pumping vanes or blades 21 spiraled rearward relative to the direction of rotation of the impeller. Each blade is of substantially constant width, measured in a direction parallel to the axis of rotation, from its root to its outer tip and has a cupped leading face 22 such that both the intake edge 23 and opposite edge 24 of each blade are sharpened. The sharpened intake edge 23 of each impeller blade cooperates with the circumferential sides 25 and forward sides 26 of the arcuate intake apertures 20 for a slicing and cutting action of the type achieved in the pump of U.S. Pat. No. 4,842,479, for example. In addition, the free end portion 27 of each blade extends outward beyond the outer sides 25 of the intake apertures. In this radially outer zone, the inside surface of the intake plate 10 is provided with a short anvil rib 28 which projects from the otherwise planar inner surface of the intake plate exposed to the pump bowl. Such rib 28 is linear but does not extend precisely radially. From the inner end of the rib, the rib extends outward and forward relative to the direction of rotation of the impeller such that a blade tip portion slices gradually over the length of the rib as seen in FIG. 5. The tendency is to urge solid matter outward and circumferentially of the bowl toward the outlet as the material is sliced. Each blade has an end notch 29 so that the inner portion of the intake edge of the blade is in close cutting relationship to the inlet apertures while the outer portion passes closely along and over the anvil rib 28.

At the closed side of the pump bowl, a chopper plate or disk 30 is provided with at least one, preferably two, inward-projecting anvil ribs 31 best seen in FIG. 4. Disk 30 can be fastened to the closed side of the pump casing or ribs 31 can be cast or machined into the casing. Such ribs extend linearly outward from the central bore 32 which closely receives the hub 33. Preferably, ribs 31 extend almost radially such that the cutting edges 24 of the impeller blades which are swept rearward in the direction of impeller rotation pass closely across the ribs gradually from the radially inner portion of each blade toward its radially outer portion, as seen in FIG. 7, for an outward-directed slicing action at the closed side of the pump bowl. Again, the tendency is to force solid matter outward and circumferentially for passage to the pump outlet.

In addition to the cutting action achieved by cooperation of the intake edges 23 of the impeller with the sides of the intake apertures 20, the slicing action achieved inside the pump bowl by the notched tip portions 27 of the blades in combination with the abrupt intake surface anvil rib 28, and the slicing action achieved at the closed side of the bowl by cooperation of the sharpened edges 24 of the impeller blades with the abrupt anvil ribs 31, preferably the pump in accordance with the present invention also has at least one external cutter-chopper 34 coupled to and rotated with the impeller. In the embodiment illustrated in FIGS. 2 through 11, the intake plate 10 has a cylindrical outward-opening depression or recess 35 in which the external cutter 34 rotates. Such cutter can have an externally threaded stud 36 for reception in an internally threaded end bore 37 of the impeller drive shalt 12 and a circular stepped hub 38 journaled in the central aperture 39 of the intake end plate 10. Cutter 34 has two blades 40 extending oppositely from the hub. Narrow anvil ribs 41 extend radially outward and project axially from the otherwise planar outer face 42 of the base of the end plate recess 35. Such ribs include inner portions extending across the joining sections 43 between the arcuate intake apertures 20 and outer portions extending across the unapertured annular portion 44 of the end plate surrounding the apertures. Such outer portions of the base ribs 41 lead to side ribs 45 extending axially along the peripheral wall 46 of the end plate depression and projecting abruptly radially inward. Preferably, additional side ribs 47 are spaced along such wall.

The external cutter blades 40 include linear sharpened leading edges 48 in close cutting relationship to the base ribs 41 as the cutter is rotated. In addition, each blade has an outturned tip or fin 49 extending generally perpendicularly from the radial portion of the blade and sharpened for cutting cooperation with the anvil ribs 45 and 47 spaced around the circumference of the end plate recess. As seen in FIG. 11, preferably the generally radially extending portions of the blades 40 taper in circumferential thickness from their edges 50 adjacent to the end plate to their edges 51 spaced outward therefrom. As seen in FIG. 10, the fins 49 taper in thickness from their base or root portions to their outer tips 52 and have inner surfaces 53 beveled inward and rearward relative to the direction of cutter rotation. The angled leading faces 54 of the external cutter blades and the beveled surfaces 53 of the fins help to clear material from the pump intake if such material does not readily pass into the pump through the apertures 20.

The external cutter 34 also includes an outer circular hub 57 of a diameter approximately equal to the inner diameter of the arcuate intake apertures 20. During manufacture, such hub is approximately hemispherical, but two axially extending teeth 55 are formed by cutting a wide groove 56 through the hub at an angle of approximately 45° relative to the direction of projection of each of the external cutter blades 40. The resulting teeth have sharp arcuate cutting edges that grind and chew through tough materials, particularly sinewy materials, and prevent such materials from winding around the external cutter and thereby blocking the intake apertures and/or impeding rotation of the cutter or the impeller.

The combined effect is to chew and grind solid matter by the external teeth 55, chop and slice such matter externally of the pump casing by the cutter 34 in cooperation with the base and side ribs 41, 45 and 47, and continue to slice and chop such matter inside the pump at both the intake side and the closed side of the pump bowl.

Figure 13:
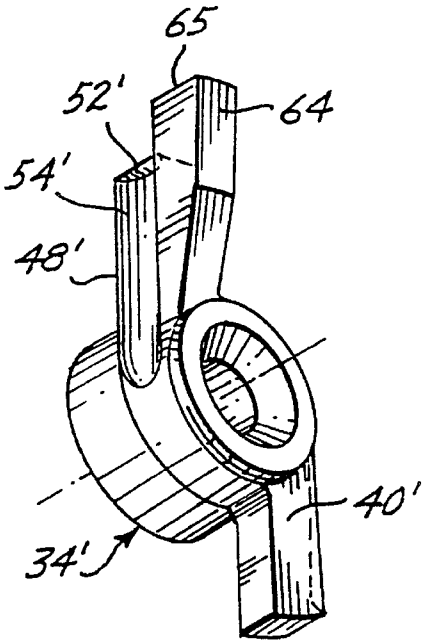
FIG. 13 is a perspective of the modified external cutter of FIG. 12 in a different rotated position.
Figure 12:
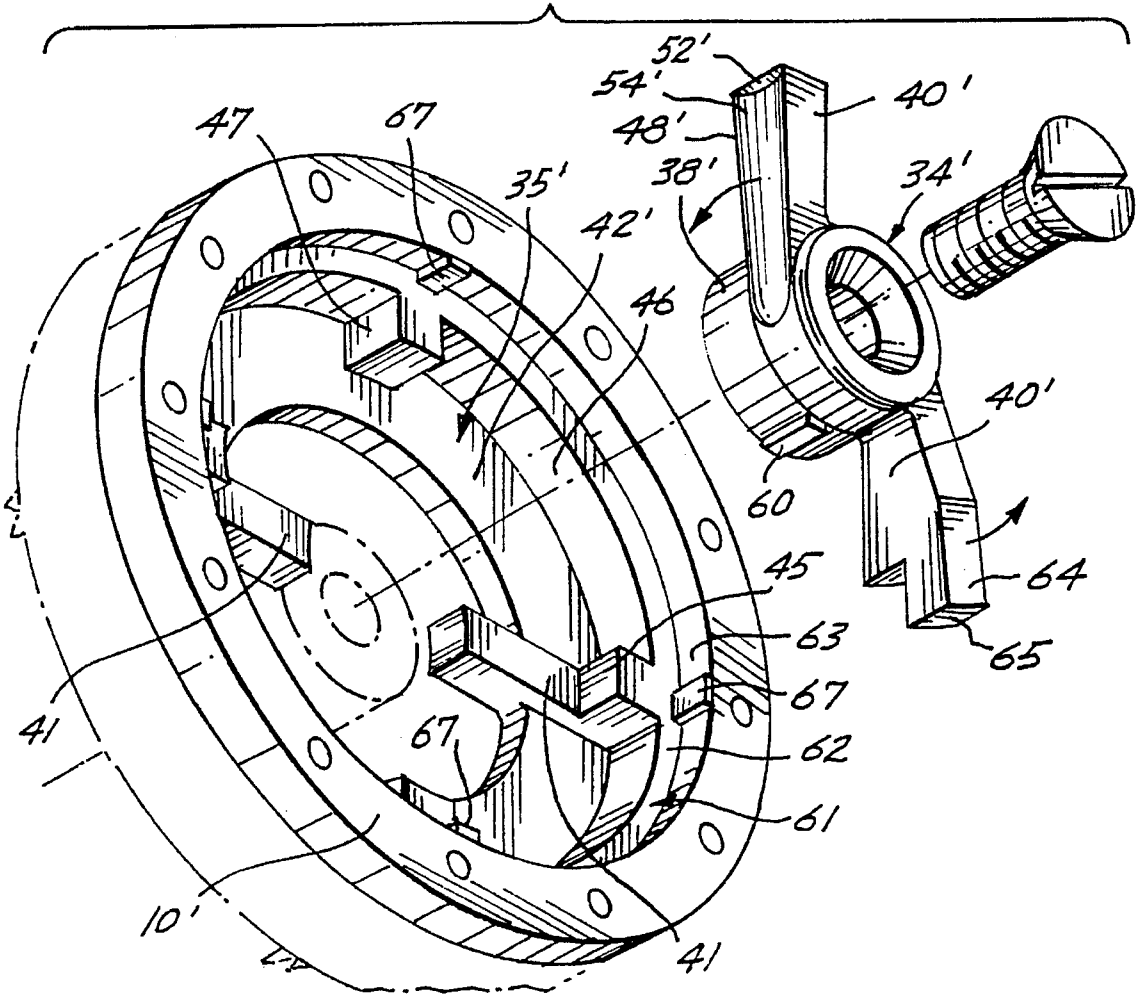
FIG. 12 is a perspective of components of a modified multistage centrifugal chopper pump in accordance with the present invention, namely, a modified intake plate and external cutter, with parts shown in exploded relationship.
Figure 15:
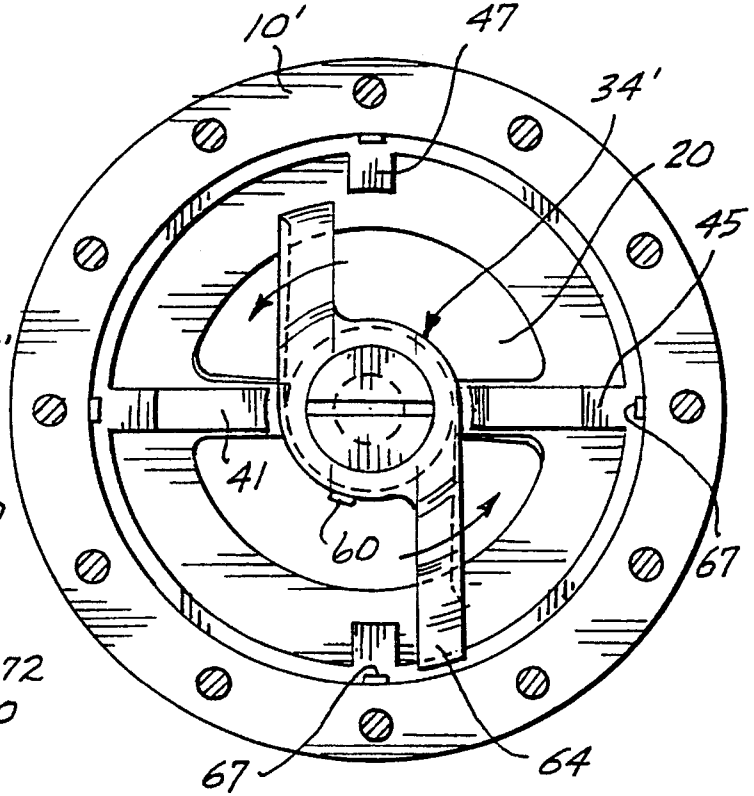
FIG. 15 is a section taken along line 15—15 of FIG. 14.

The modified external cutter-chopper 34' shown in FIGS. 12 and 13 has oppositely extending blades 40' for rotating in a modified end plate 10'. End plate 10' has a stepped outward-opening depression or recess, including an inner portion 35' having a base 42' which is planar except for the short, narrow, radially extending anvil ribs 41. As in the earlier described embodiment, ribs 41 lead to side ribs 45 which extend axially along the peripheral wall 46 of the inner recess portion 35'. Additional side ribs 47 are spaced midway between the opposing ribs 45.

The hub 38' of the modified external cutter 34' is of a diameter slightly less than the distance between the inner ends of the base anvil ribs 41. Such hub has an abrupt projection 60 extending in an axial direction for achieving a central chopping action as it passes the inner ends of ribs 41. The leading faces 54' of the wings 40' are concave to form the sharpened leading edges 48' and the sharpened tip portions 52' which cooperate with the ribs 41, 45 and 47 for an abrupt chopping action as the external cutter 34' rotates in the inner portion 35' of the end plate recess.

End plate 10' has an outer recess 61 of a diameter greater than the diameter of the inner recess portion 35'. Consequently, an annular shoulder 62 in a diametral plane is formed outward of the inner recess portion 35', terminating at a short peripheral wall 63. At least one of the blades 40' of cutter 34' has an outer finger 64 projecting beyond the inner portion of the blade fitted in the inner recess portion 35'. Finger 64 rotates in the larger outer recess 61. The outer end 65 of finger 64 passes close to additional short and narrow anvil ribs 67 projecting inward from the peripheral wall 63 for an additional stage of chopping as material passes into the pump.

Figure 14:
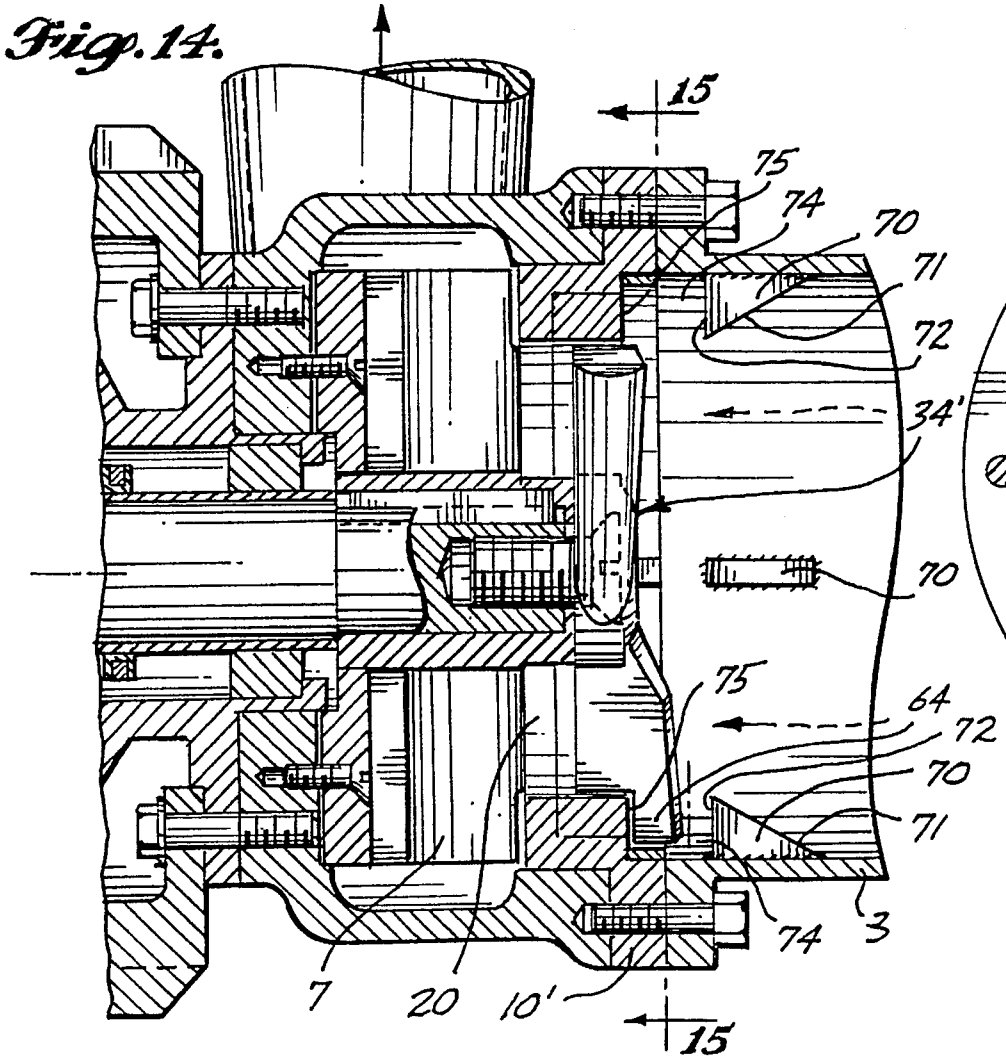
FIG. 14 is a side elevation of a multistage centrifugal chopper pump having the modified components of FIG. 12, with parts broken away to reveal the interior of the pump bowl and adjacent structure including a modified intake manifold.

For particularly hard synthetic plastic materials, which may be included in medical waste, there may be a tendency for the material to catch on a blade of an external cutter or be slapped away from the pump inlet. With reference to FIG. 14, the intake pipe or manifold 3 can have triangular flow restrictor bars 70 with angled faces 71 inclined toward the pump inlet and radial faces 72 spaced a short distance outward from the intake plate 10'. Hard, solid objects fed toward the external cutter 34' will be flung outward, if not chopped immediately, and are trapped in the wide grooves 74 formed between the inner faces 72 of the restrictor bars 70 and the outer annular surface 75 of the intake plate. The abrupt impact of the finger 64 of the external chopper 34' breaks or chops the hard object effectively, until it has been reduced in size sufficiently to pass farther inward where it is repeatedly chopped by the external cutter in cooperation with the pump intake apertures 20 and by the impeller 7 as the solid object passes into and through the pump.

Figure 16:
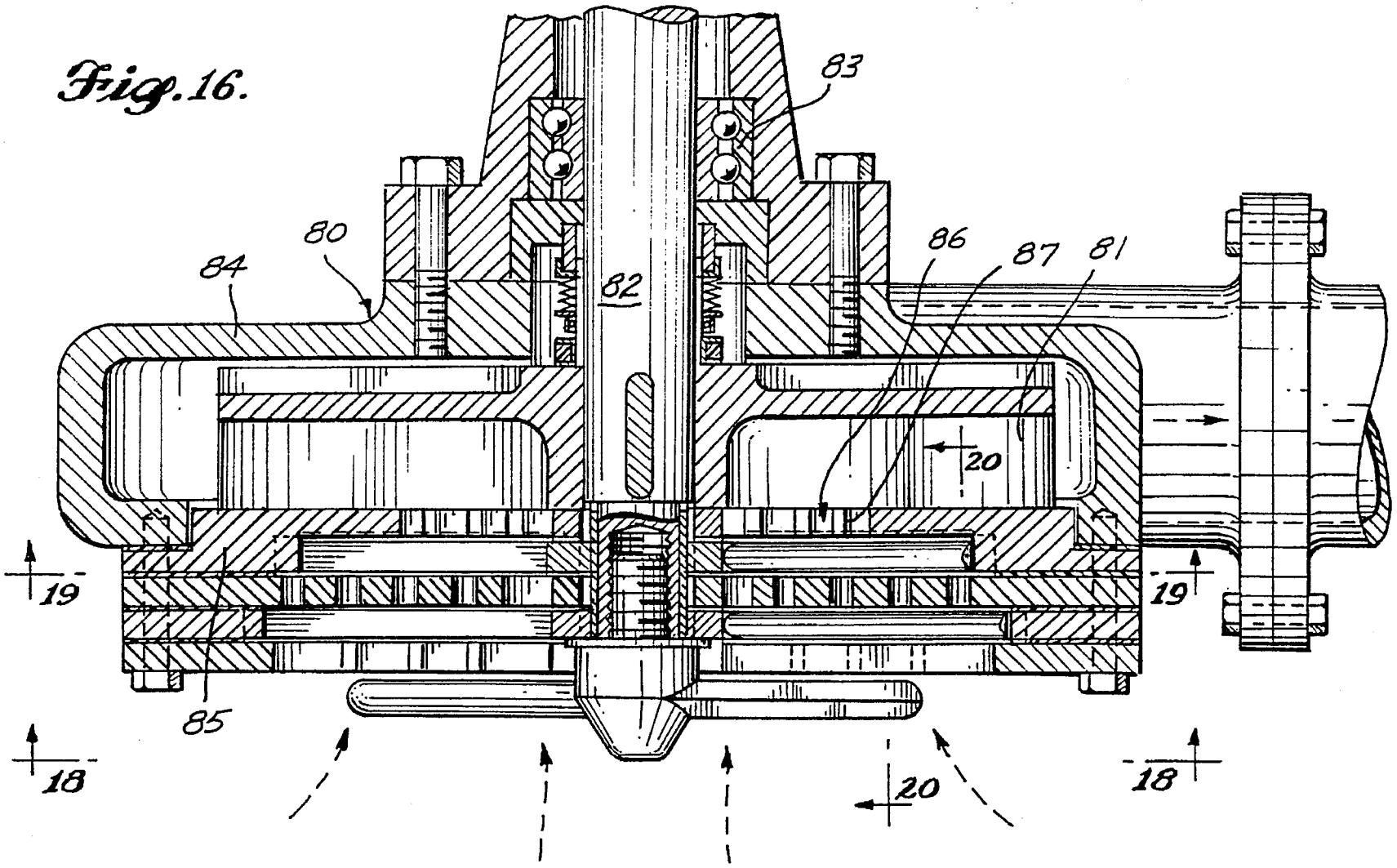
FIG. 16 is a side elevation of another embodiment of a multistage centrifugal chopper pump in accordance with the present invention, with parts broken away to reveal the interior of the pump bowl and adjacent structure.
Figure 17:
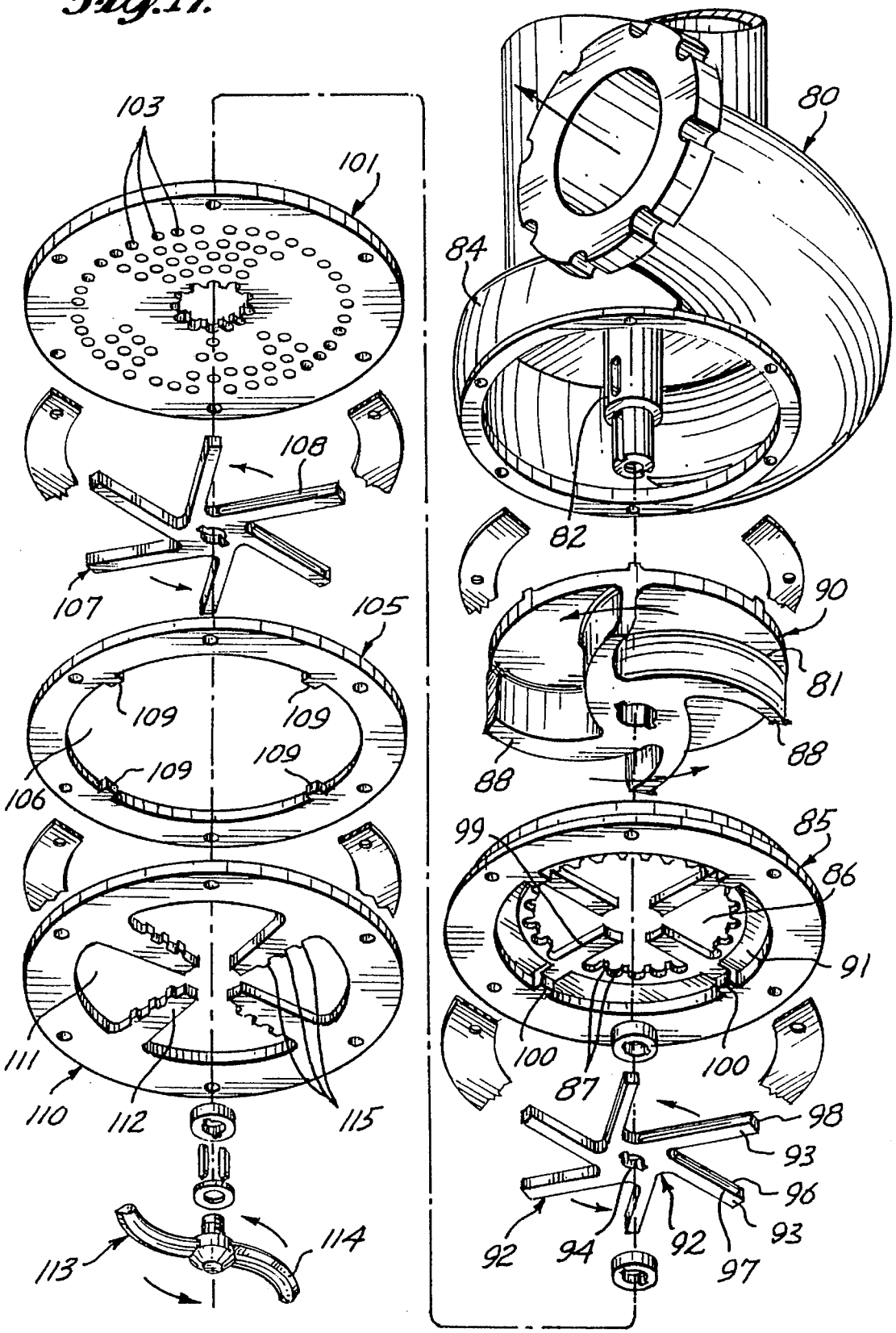
FIG. 17 is a perspective of components of the pump of FIG. 16 taken from the closed side of the pump bowl, with parts shown in exploded relationship.

Another embodiment of a multistage centrifugal chopper pump in accordance with the present invention is illustrated in FIGS. 16–21. With reference to FIGS. 16 and 17, similar to the previously described embodiments, pump 80 has an internal impeller 81 rotated by a drive shaft 82 journaled in bearings 83 at the closed side of the pump casing 84 which defines the bowl. The open side of the bowl is closed by an intake plate 85. Intake plate 85 has a central intake opening 86 with a scalloped peripheral edge 87 best seen in FIG. 17 which helps to catch and trap solid, particularly stringy, material entering into the pump for slicing or chopping by the impeller blades 88. Unlike the previously described embodiments, impeller 81 is of the semi-open type having a radial shroud plate 90 so that, internally of the pump bowl, the chopping action is achieved only at the outer edges of the blades 88 adjacent to the intake plate.

Figure 20:
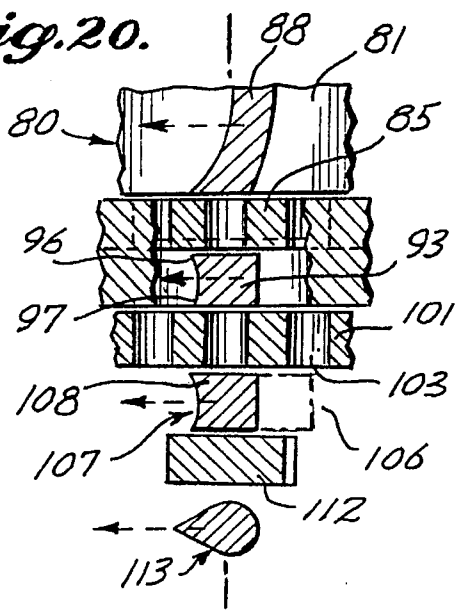
FIG. 20 is a somewhat diagrammatic fragmentary section taken along line 20—20 of FIG. 16.
Figure 21:
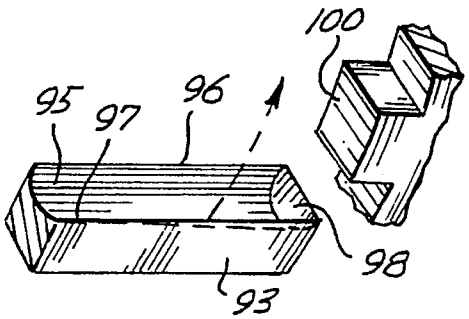
FIG. 21 is an enlarged, fragmentary, detail perspective of components of the pump of FIG. 16, namely, the radially outer end portion of an external cutter blade and a cooperating anvil rib.
Figure 19:
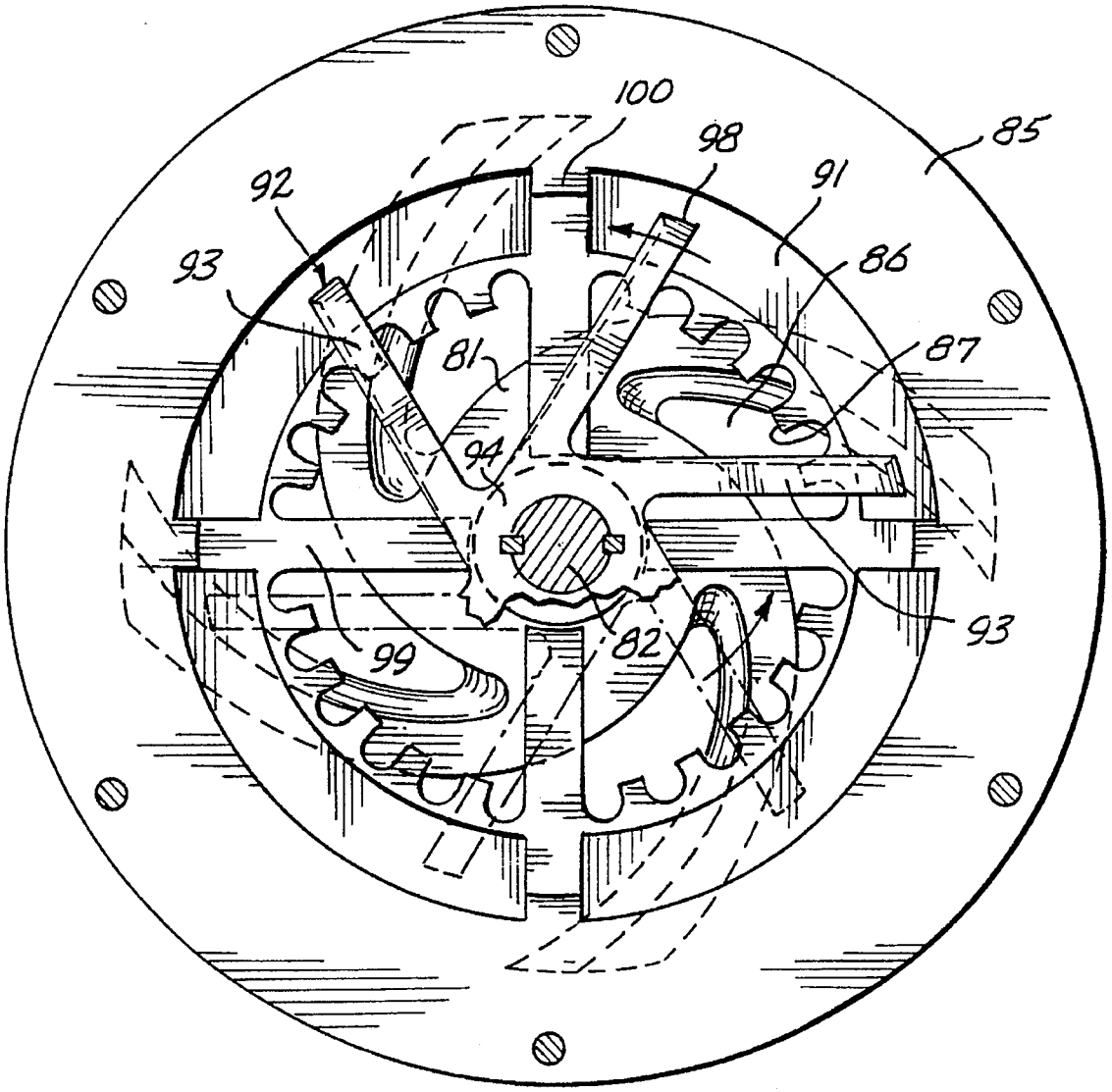
FIG. 19 is a section along line 19—19 of FIG. 16, with parts broken away.

With reference to FIG. 17, intake plate 85 has an outward opening recess 91 receiving an external cutter 92 which is rotated with the pump impeller. Cutter 92 has several blades 93 extending generally tangentially from the central hub 94. As best seen in FIGS. 20 and 21, blades 93 have concave leading edges 95 such that the long inner and outer edge portions 96 and 97 of the blades are sharpened, as well as the outer tip portions 98 (FIG. 17). The inner edges 96 are in close slicing or chopping contact with raised anvil ribs 99 (FIG. 17) of the intake plate 85, such ribs extending generally radially; whereas the sharpened blade tip portions 98 (FIG. 21) pass close to side anvil ribs 100 projecting inward from the peripheral wall of the intake plate recess.

An apertured plate 101 having a central hole for the drive shaft 82 extends across the intake plate recess 91 such that the external cutter 92 is fitted between the intake plate 85 and the apertured plate 101. The outer long sharpened edges 97 of the external cutter blades 93 pass close to the apertured plate for additional chopping and slicing of material entering the pump. The sizes of the holes 103 in the plate determine the maximum size of material allowed into the pump.

A spacer ring 105 of approximately the same axial thickness as the apertured plate 85 is centered over the apertured plate to define an additional outward opening recess 106 for a second external cutter 107. Cutter 107 can be of the same design as the first internal cutter 92 with its blades 108 being slightly longer to fit in the larger recess 106. The spacer plate 105 has short inward projecting anvil ribs 109 which cooperate with the sharpened ends of the blades 108 of the second external cutter 107. Also, the sharpened inner edges of the blades pass close to the outer face of the apertured plate 101 for chopping solid material as it enters the plate apertures. However, cutter 107 may be exposed to larger chunks of hard or tough material than the first internal cutter 92 which is located inside the apertured plate 101. Consequently, greater force may be applied to cutter 107 and it may be desirable to increase the width of blades 108, as shown in broken lines in FIG. 20. Also, if a wider blade is used, it may be necessary to use fewer than six blades on cutter 107, so as to reduce the area of the apertured plate 101 blocked by the cutter blades. If too large an area of the apertured plate is blocked, pump performance can be affected.

Yet another ring 110 is secured outside the spacer 105 forming the outside inlet openings 111 between inward projecting arms 112. The inner ends of such arms define an opening for the hub of a third external cutter 113 having blades 114 swept back relative to the direction of impeller rotation and having beveled top and bottom surfaces terminating at the sharpened leading edges spaced outward from plate 110. The arms 112 of the plate have teeth 115 along edges facing the oncoming blades for trapping and ripping solid material entering the pump. The long sharpened outer edges of the blades 108 of the second outermost external cutter 107 are in close cutting relationship to the inner sides of the arms 112.

Figure 18:
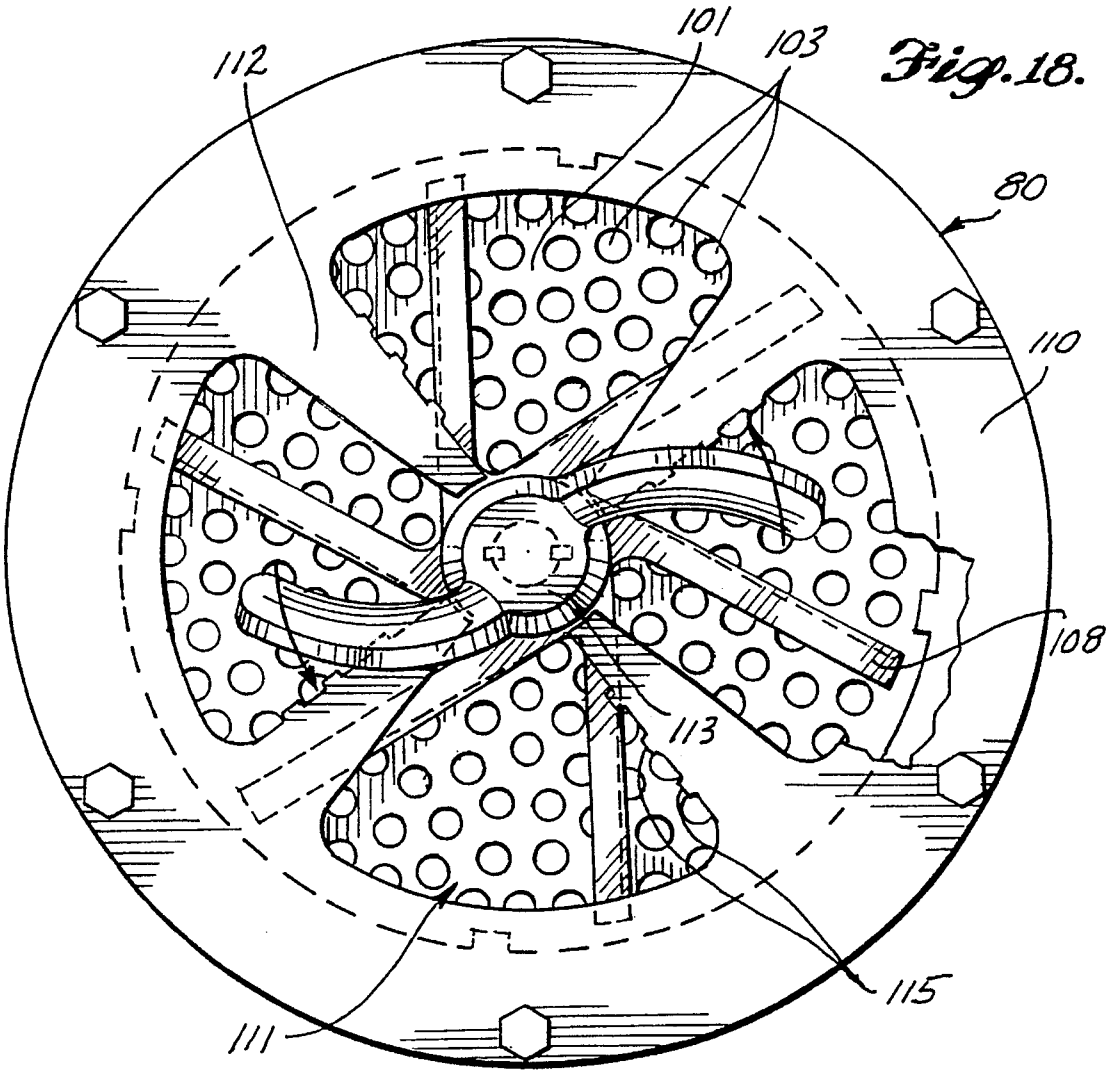
FIG. 18 is an intake end elevation of the pump of FIG. 16, viewed from line 18—18 of FIG. 16.

With reference to FIG. 18 and FIG. 20, material entering the pump 80 first is engaged by the outermost cutter 113 which deflects large solid material outward and slices and chops solid material as it enters between the inward extending arms 112. The teeth 115 on arms 111 help to trap the material so that it will be cut by the outermost cutter in addition to being sliced and chopped by the blades of the next innermost cutter 107. Only material of a diameter less than the diameter of the holes 103 of the apertured plate 101 will pass to the next stage of the pump for additional slicing and chopping action by the blades 93 of the first external cutter 92 in cooperation with the inner side of the apertured plate 101 and the outer side of the intake plate 85. Finally, the outer sharpened edges of the impeller blades 88 achieve a final slicing and chopping of solid material passing into the pump.

The semi-open impeller design of the embodiment of the present invention illustrated in FIGS. 16–21 generates substantially greater suction into the pump which, if desired, can be assisted by shaping the outermost cutter 113 as a booster propeller. Thus, any material tending to lodge in the apertured plate, for example, is sucked and pushed through to the final cutter stages. This design has been found to be particularly effective in the case of fish waste from canneries which may contain tough skin, cartilage, bone and soft tissue and organs of various sizes. At a cannery, it is important that the waste be chopped to a sufficiently small size that it will be carded away by tidal action for environmentally safe decomposition in the ocean, rather than collecting at a localized area close to the cannery where large amounts of the rotting waste are smelly and potentially environmentally dangerous.

Where there is harder and tougher material to be chopped, such as a variety of unprocessed medical waste, the embodiment of the invention shown in FIGS. 1–11 or 13–15 is preferred, although the open impeller design with chopping at both sides decreases the head and capacity of the pump.

In either case, a wide variety of refuse can be chopped and pumped effectively and without clogging.

The embodiments of the invention in which an exclusive property or privilege is claimed are defined as follows:

1. In a centrifugal pump having a bladed impeller rotatable about an axis, a pump casing including a bowl receiving the impeller blades and having an inlet side for intake of material into the pump bowl, the pump casing including an intake plate extending across the inlet side of the pump bowl, the improvement comprising a hub rotated with the impeller and extending through the intake plate, generally axially outward from the impeller blades, said hub having an abrupt projection in close cutting relationship with at least a portion of said intake plate as the impeller is rotated.

2. In the pump defined in claim 1, the intake plate including at least one radially extending rib having an inner end adjacent to the hub, said inner end of said rib being in close cutting relationship with the abrupt projection of the hub as the hub is rotated.

3. In the pump defined in claim 1, the improvement further comprising an external cutter positioned at the opposite side of the intake plate from the impeller blades, said external cutter being rotated with the impeller and the hub and having a portion in close cutting relationship to at least a portion of the intake plate.

* * * * *